US010963953B2

(12) United States Patent
Sweeder et al.

(10) Patent No.: US 10,963,953 B2
(45) Date of Patent: Mar. 30, 2021

(54) RESERVE MANAGEMENT FOR CONTINUOUS BIDDING PORTAL

(71) Applicant: Alliance Inspection Management, LLC, Long Beach, CA (US)

(72) Inventors: Scott Sweeder, Sterling Heights, MI (US); Eric Widmer, Long Beach, CA (US); Tammy Allen, Novi, MI (US)

(73) Assignee: Alliance Inspection Management, LLC, Long Beach, CA (US)

( * ) Notice: Subject to any disclaimer, the term of this patent is extended or adjusted under 35 U.S.C. 154(b) by 199 days.

(21) Appl. No.: 16/156,936

(22) Filed: Oct. 10, 2018

(65) Prior Publication Data

US 2020/0118203 A1 Apr. 16, 2020

(51) Int. Cl.
*G06Q 30/00* (2012.01)
*G06Q 30/08* (2012.01)

(52) U.S. Cl.
CPC ..... *G06Q 30/08* (2013.01)

(58) Field of Classification Search
CPC .... G06Q 30/00; G06Q 30/08; G06Q 30/0601; G06Q 30/0641
See application file for complete search history.

(56) References Cited

U.S. PATENT DOCUMENTS 6,397,131 B1 5/2002 Busch et al.
6,871,190 B1 3/2005 Seymour et al.
7,734,505 B2 6/2010 Miller et al.
7,865,420 B1 * 1/2011 Daman ..... G06Q 40/04 705/37
8,165,848 B2 4/2012 Knight et al.
8,868,480 B2 10/2014 McBride et al.
9,064,290 B2 6/2015 Kneppers et al.
9,103,743 B2 8/2015 Couch
2001/0049653 A1 12/2001 Sheets
2002/0029185 A1 3/2002 Tanaka et al.
(Continued)

FOREIGN PATENT DOCUMENTS

JP 2010-044778 A 2/2010

OTHER PUBLICATIONS

PCT/US2019/055699, "Notification of Transmittal of the International Search Report and the Written Opinion of the International Searching Authority, or the Declaration", PCT International Searching Authority, dated Jan. 6, 2020, pp. 1-9.
(Continued)

*Primary Examiner* — Christopher B Seibert
(74) *Attorney, Agent, or Firm* — Kunzler Bean & Adamson

(57) ABSTRACT

An apparatus, system, method, and program product is disclosed for reserve management for a continuous bidding portal. A method includes receiving a notification comprising bid information for an auction item posted on a first auction platform. The bid information includes a bid amount. A method includes determining that the bid amount satisfies a reserve price for the auction item posted on the first auction platform. A method includes sending a notification to one or more second auction platforms where the auction item is posted to remove auction listings for the auction item from the one or more second auction platforms in response to the reserve price for the auction item being met at the first auction platform.

16 Claims, 7 Drawing Sheets

(56) References Cited

U.S. PATENT DOCUMENTS

2002/0082977 A1* 6/2002 Hammond ..... G06Q 40/04 705/37
2002/0169705 A1 11/2002 Gutierrez et al.
2003/0036964 A1 2/2003 Boyden et al.
2003/0125038 A1* 7/2003 Western ..... H04W 72/121 455/452.1
2003/0212619 A1 11/2003 Jain et al.
2004/0080545 A1* 4/2004 Kobal ..... G06F 3/0482 715/824
2004/0109030 A1* 6/2004 Farrington ..... G06F 9/453 715/808
2004/0128224 A1 7/2004 Dabney et al.
2005/0256780 A1 11/2005 Eldred
2006/0047581 A1 3/2006 La Mura et al.
2006/0085283 A1 4/2006 Griffiths
2006/0259392 A1 11/2006 Rabenold et al.
2007/0112644 A1* 5/2007 Grove ..... G06Q 30/08 705/26.3
2007/0136077 A1 6/2007 Hammond et al.
2007/0214075 A1 9/2007 Ablan
2007/0250232 A1 10/2007 Dourney, Jr. et al.
2008/0021811 A1 1/2008 Brader-Araje et al.
2010/0312664 A1* 12/2010 Roseman ..... G06Q 30/06 705/26.3
2011/0145087 A1* 6/2011 Daman ..... H04L 67/12 705/26.3
2011/0320959 A1 12/2011 Maly
2012/0059725 A1 3/2012 Colson et al.
2013/0041781 A1 2/2013 Freydberg
2013/0204732 A1* 8/2013 Moskos ..... G06Q 30/08 705/26.3
2013/0268446 A1* 10/2013 Buschmann ..... G06Q 30/01 705/304
2013/0290124 A1* 10/2013 Drake ..... G06Q 30/08 705/26.3
2014/0067614 A1 3/2014 Hygema et al.
2014/0101146 A1 4/2014 Scriffignano et al.
2014/0149252 A1 5/2014 Rabenold et al.
2015/0287132 A1* 10/2015 Hudson ..... G06Q 30/08 705/26.3
2017/0061529 A1 3/2017 Sweeder et al.

OTHER PUBLICATIONS

PCT/US2019/055699, The Patent Analyst, "Search History—Limited Classification Search", Dec. 11, 2019, pp. 1-3.
PCT/US2016/049301, International Search Report, dated Dec. 5, 2016.
PCT/US2016/049301, Written Opinion of the International Searching Authority, dated Dec. 5, 2016.

* cited by examiner

RESERVE MANAGEMENT FOR CONTINUOUS BIDDING PORTAL

FIELD

The subject matter disclosed herein relates to online auctions and more particularly relates to managing auction items with reserve in a continuous bidding portal that uses a plurality of incompatible auction platforms.

BACKGROUND

Online auctions allow users to post items to sell and/or view items for sale posted by other users. There may be various different auction platforms, each built with different technologies, e.g., web technologies, which may make them incompatible with one another. For example, a user may post a car for sale on multiple auction platforms, but when a bid for the car is received on an auction platform, the bid information may not be transmitted or shared with the other auction platforms where the car is posted for sale.

BRIEF SUMMARY

An apparatus for reserve management for a continuous bidding portal is disclosed. A method and program product perform the functions of the apparatus. A method, in one embodiment, includes receiving a notification comprising bid information for an auction item posted on a first auction platform. The bid information may include a bid amount. A method, in further embodiments, includes determining that the bid amount satisfies a reserve price for the auction item posted on the first auction platform. A method, in various embodiments, includes sending a notification to one or more second auction platforms where the auction item is posted to remove auction listings for the auction item from the one or more second auction platforms in response to the reserve price for the auction item being met at the first auction platform.

In one embodiment, the method includes continuing the auction on the first auction platform where the bid amount satisfying the reserve price was received for the auction item until the auction is completed. In certain embodiments, the method includes continuously sending the notification to remove the auction listing in response to the reserve price being satisfied to a second auction platform until a confirmation notification is received from the second auction platform. The confirmation notification may indicate that the auction listing has been removed from the second auction platform.

In some embodiments, the method includes selecting a bid of a plurality of bids received substantially at a same time from different auction platforms. The bid is selected based on the time the notifications were received from the auction platforms. In certain embodiments, the method includes sending a notification to each auction platform associated with each bid that is not selected that the bid was rejected.

In some embodiments, determining that the bid amount satisfies a reserve price for the auction item posted on the first auction platform comprises receiving a notification from the first auction platform that the reserve price has been met. In certain embodiments, determining that the bid amount satisfies a reserve price for the auction item posted on the first auction platform comprises comparing the received bid amount to the reserve price at an auction management device.

In a further embodiment, the method includes creating the listing for the item. The listing may include a description of the item, an initial bid price, an auction end time, a listing type, a reserve price, and one or more selected auction platforms where the listing is posted. In some embodiments, the method includes extending the auction end time until a reserve price for the auction item is met at an auction platform.

In one embodiment, the listing further includes a plurality of iterations for the listing. The plurality of iterations specifying a number of times the listing is listable at an auction platform to receive a bid amount satisfying the reserve price. In various embodiments, the method includes removing the listing from the one or more second auction platforms in response to the reserve price for the auction item being met at the first auction platform even if the listing has additional iterations at an auction platform.

In one embodiment, notifications comprising reserve information are sent and received between an auction management device and an auction platform using an application programming interface ("API"). The auction management device may format sent messages according to the API of the auction platform and convert received messages from the format of the API of the auction platform.

In some embodiments, notifications are formatted using one or more of extensible markup language ("XML") and JavaScript Object Notation ("JSON"). In certain embodiments, an auction platform polls an auction management device at predetermined intervals to determine if a reserve price has been met for the auction item at a different auction platform.

An apparatus for reserve management for a continuous bidding portal includes a processor and memory that stores code executable by the processor to receive a notification comprising bid information for an auction item posted on a first auction platform. In one embodiment, the bid information includes a bid amount. The executable code is further executable by the processor to determine that the bid amount satisfies a reserve price for the auction item posted on the first auction platform. The executable code is further executable by a processor to send a notification to one or more second auction platforms where the auction item is posted to remove auction listings for the auction item from the one or more second auction platforms in response to the reserve price for the auction item being met at the first auction platform.

In one embodiment, the code is further executable by the processor to continue the auction on the first auction platform where the bid amount satisfying the reserve price was received for the auction item until the auction is completed. In further embodiments, the code is further executable by the processor to continuously send the notification to remove the auction listing in response to the reserve price being satisfied to a second auction platform until a confirmation notification is received from the second auction platform. The confirmation notification may indicate that the auction listing has been removed from the second auction platform.

In various embodiments, determining that the bid amount satisfies a reserve price for the auction item posted on the first auction platform comprises receiving a notification from the first auction platform that the reserve price has been met. In further embodiments, determining that the bid amount satisfies a reserve price for the auction item posted on the first auction platform comprises comparing the received bid amount to the reserve price at an auction management device.

A system for reserve management for a continuous bidding portal, in one embodiment, includes an auction management device, a first auction platform, and one or more second auction platforms. In certain embodiments, the system includes a notification module configured to receive, at the auction management device, a notification comprising bid information for an auction item posted on the first auction platform. The bid information may include a bid amount. In certain embodiments, the system includes a reserve module configured to determine that the bid amount satisfies a reserve price for the auction item posted on the first auction platform. In some embodiments, the system includes an update module configured to send a notification to the one or more second auction platforms where the auction item is posted from the auction management device to remove auction listings for the auction item from the one or more second auction platforms in response to the reserve price for the auction item being met at the first auction platform.

BRIEF DESCRIPTION OF THE DRAWINGS

In order that the advantages of the invention will be readily understood, a more particular description of the invention briefly described above will be rendered by reference to specific embodiments that are illustrated in the appended drawings. Understanding that these drawings depict only typical embodiments of the invention, and are not therefore to be considered to be limiting of its scope, the invention will be described and explained with additional specificity and detail through the use of the accompanying drawings, in which.

DETAILED DESCRIPTION

Figure 1:
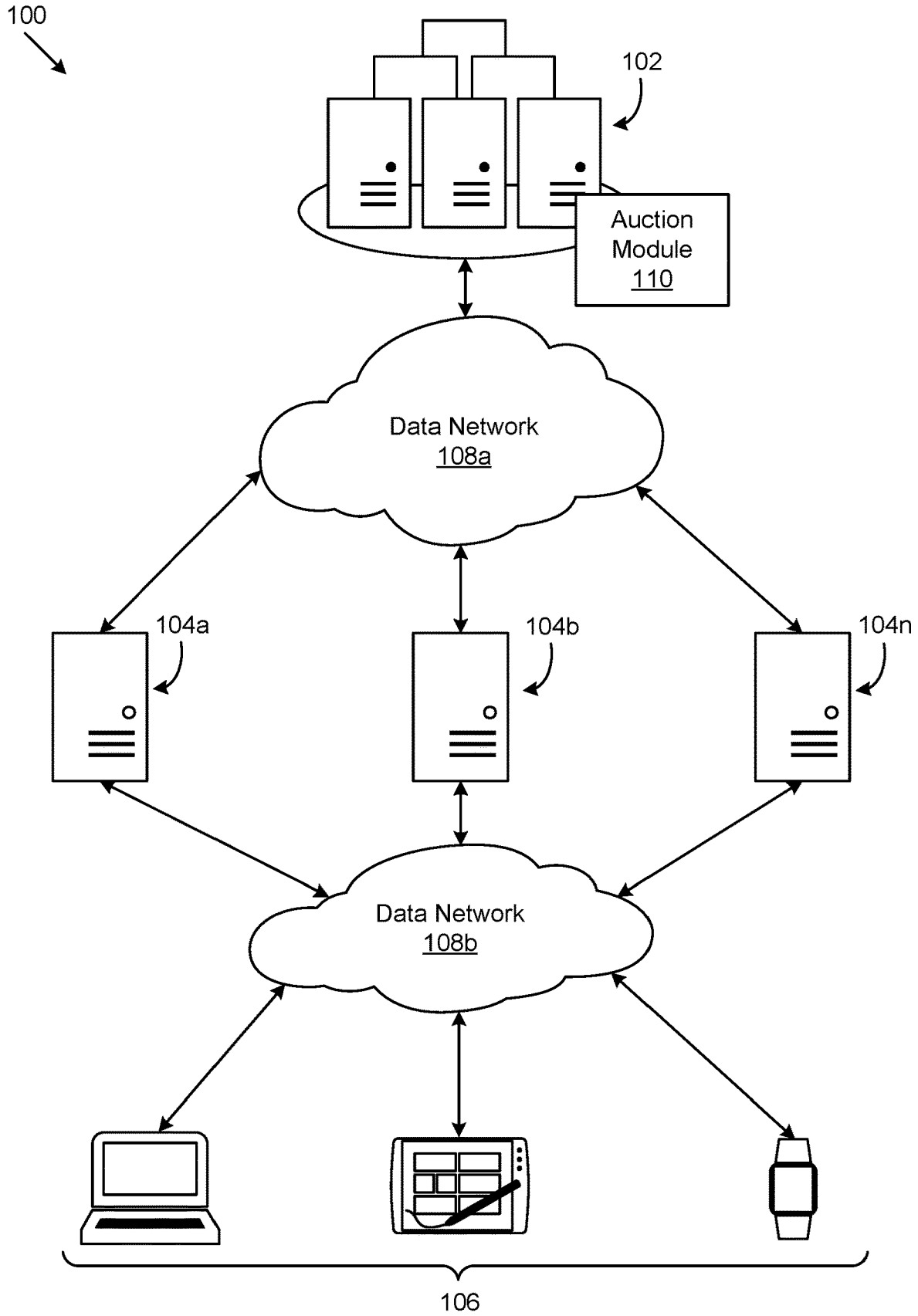
FIG. 1 depicts a schematic block diagram of one embodiment of a system for reserve management for a continuous bidding portal.

Reference throughout this specification to "one embodiment," "an embodiment," or similar language means that a particular feature, structure, or characteristic described in connection with the embodiment is included in at least one embodiment. Thus, appearances of the phrases "in one embodiment," "in an embodiment," and similar language throughout this specification may, but do not necessarily, all refer to the same embodiment, but mean "one or more but not all embodiments" unless expressly specified otherwise. The terms "including," "comprising," "having," and variations thereof mean "including but not limited to" unless expressly specified otherwise. An enumerated listing of items does not imply that any or all of the items are mutually exclusive and/or mutually inclusive, unless expressly specified otherwise. The terms "a," "an," and "the" also refer to "one or more" unless expressly specified otherwise.

Furthermore, the described features, advantages, and characteristics of the embodiments may be combined in any suitable manner. One skilled in the relevant art will recognize that the embodiments may be practiced without one or more of the specific features or advantages of a particular embodiment. In other instances, additional features and advantages may be recognized in certain embodiments that may not be present in all embodiments.

These features and advantages of the embodiments will become more fully apparent from the following description and appended claims, or may be learned by the practice of embodiments as set forth hereinafter. As will be appreciated by one skilled in the art, aspects of the present invention may be embodied as a system, method, and/or computer program product. Accordingly, aspects of the present invention may take the form of an entirely hardware embodiment, an entirely software embodiment (including firmware, resident software, micro-code, etc.) or an embodiment combining software and hardware aspects that may all generally be referred to herein as a "circuit," "module," or "system." Furthermore, aspects of the present invention may take the form of a computer program product embodied in one or more computer readable medium(s) having program code embodied thereon.

Many of the functional units described in this specification have been labeled as modules, in order to more particularly emphasize their implementation independence. For example, a module may be implemented as a hardware circuit comprising custom VLSI circuits or gate arrays, off-the-shelf semiconductors such as logic chips, transistors, or other discrete components. A module may also be implemented in programmable hardware devices such as field programmable gate arrays, programmable array logic, programmable logic devices or the like.

Modules may also be implemented in software for execution by various types of processors. An identified module of program code may, for instance, comprise one or more physical or logical blocks of computer instructions which may, for instance, be organized as an object, procedure, or function. Nevertheless, the executables of an identified module need not be physically located together, but may comprise disparate instructions stored in different locations which, when joined logically together, comprise the module and achieve the stated purpose for the module.

Indeed, a module of program code may be a single instruction, or many instructions, and may even be distributed over several different code segments, among different programs, and across several memory devices. Similarly, operational data may be identified and illustrated herein within modules, and may be embodied in any suitable form and organized within any suitable type of data structure. The operational data may be collected as a single data set, or may be distributed over different locations including over different storage devices, and may exist, at least partially, merely as electronic signals on a system or network. Where a module or portions of a module are implemented in software, the program code may be stored and/or propagated on in one or more computer readable medium(s).

The computer readable medium may be a tangible computer readable storage medium storing the program code. The computer readable storage medium may be, for example, but not limited to, an electronic, magnetic, optical, electromagnetic, infrared, holographic, micromechanical, or semiconductor system, apparatus, or device, or any suitable combination of the foregoing.

More specific examples of the computer readable storage medium may include but are not limited to a portable computer diskette, a hard disk, a random access memory (RAM), a read-only memory (ROM), an erasable programmable read-only memory (EPROM or Flash memory), a portable compact disc read-only memory (CD-ROM), a digital versatile disc (DVD), an optical storage device, a magnetic storage device, a holographic storage medium, a micromechanical storage device, or any suitable combination of the foregoing. In the context of this document, a computer readable storage medium may be any tangible medium that can contain, and/or store program code for use by and/or in connection with an instruction execution system, apparatus, or device.

The computer readable medium may also be a computer readable signal medium. A computer readable signal medium may include a propagated data signal with program code embodied therein, for example, in baseband or as part of a carrier wave. Such a propagated signal may take any of a variety of forms, including, but not limited to, electrical, electro-magnetic, magnetic, optical, or any suitable combination thereof. A computer readable signal medium may be any computer readable medium that is not a computer readable storage medium and that can communicate, propagate, or transport program code for use by or in connection with an instruction execution system, apparatus, or device. Program code embodied on a computer readable signal medium may be transmitted using any appropriate medium, including but not limited to wire-line, optical fiber, Radio Frequency (RF), or the like, or any suitable combination of the foregoing.

In one embodiment, the computer readable medium may comprise a combination of one or more computer readable storage mediums and one or more computer readable signal mediums. For example, program code may be both propagated as an electro-magnetic signal through a fiber optic cable for execution by a processor and stored on RAM storage device for execution by the processor.

Program code for carrying out operations for aspects of the present invention may be written in any combination of one or more programming languages, including an object oriented programming language such as VB.net, C#, .NET, Java, Smalltalk, C++, PHP or the like and conventional procedural programming languages, such as the "C" programming language or similar programming languages. The program code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider).

The computer program product may be shared, simultaneously serving multiple customers in a flexible, automated fashion. The computer program product may be standardized, requiring little customization and scalable, providing capacity on demand in a pay-as-you-go model. The computer program product may be stored on a shared file system accessible from one or more servers.

The computer program product may be integrated into a client, server and network environment by providing for the computer program product to coexist with applications, operating systems and network operating systems software and then installing the computer program product on the clients and servers in the environment where the computer program product will function.

In one embodiment software is identified on the clients and servers including the network operating system where the computer program product will be deployed that are required by the computer program product or that work in conjunction with the computer program product. This includes the network operating system that is software that enhances a basic operating system by adding networking features.

Furthermore, the described features, structures, or characteristics of the embodiments may be combined in any suitable manner. In the following description, numerous specific details are provided, such as examples of programming, software modules, user selections, network transactions, database queries, database structures, hardware modules, hardware circuits, hardware chips, etc., to provide a thorough understanding of embodiments. One skilled in the relevant art will recognize, however, that embodiments may be practiced without one or more of the specific details, or with other methods, components, materials, and so forth. In other instances, well-known structures, materials, or operations are not shown or described in detail to avoid obscuring aspects of an embodiment.

Aspects of the embodiments are described below with reference to schematic flowchart diagrams and/or schematic block diagrams of methods, apparatuses, systems, and computer program products according to embodiments of the invention. It will be understood that each block of the schematic flowchart diagrams and/or schematic block diagrams, and combinations of blocks in the schematic flowchart diagrams and/or schematic block diagrams, can be implemented by program code. The program code may be provided to a processor of a general purpose computer, special purpose computer, sequencer, or other programmable data processing apparatus to produce a machine, such that the instructions, which execute via the processor of the computer or other programmable data processing apparatus, create means for implementing the functions/acts specified in the schematic flowchart diagrams and/or schematic block diagrams block or blocks.

The program code may also be stored in a computer readable medium that can direct a computer, other programmable data processing apparatus, or other devices to function in a particular manner, such that the instructions stored in the computer readable medium produce an article of manufacture including instructions which implement the function/act specified in the schematic flowchart diagrams and/or schematic block diagrams block or blocks.

The program code may also be loaded onto a computer, other programmable data processing apparatus, or other devices to cause a series of operational steps to be performed on the computer, other programmable apparatus or other devices to produce a computer implemented process such that the program code which executed on the computer or other programmable apparatus provide processes for implementing the functions/acts specified in the flowchart and/or block diagram block or blocks.

The schematic flowchart diagrams and/or schematic block diagrams in the Figures illustrate the architecture, functionality, and operation of possible implementations of apparatuses, systems, methods and computer program products according to various embodiments of the present invention. In this regard, each block in the schematic flowchart diagrams and/or schematic block diagrams may represent a module, segment, or portion of code, which comprises one or more executable instructions of the program code for implementing the specified logical function(s).

It should also be noted that, in some alternative implementations, the functions noted in the block may occur out of the order noted in the Figures. For example, two blocks shown in succession may, in fact, be executed substantially concurrently, or the blocks may sometimes be executed in the reverse order, depending upon the functionality involved. Other steps and methods may be conceived that are equivalent in function, logic, or effect to one or more blocks, or portions thereof, of the illustrated Figures.

Although various arrow types and line types may be employed in the flowchart and/or block diagrams, they are understood not to limit the scope of the corresponding embodiments. Indeed, some arrows or other connectors may be used to indicate only the logical flow of the depicted embodiment. For instance, an arrow may indicate a waiting or monitoring period of unspecified duration between enumerated steps of the depicted embodiment. It will also be noted that each block of the block diagrams and/or flowchart diagrams, and combinations of blocks in the block diagrams and/or flowchart diagrams, can be implemented by special purpose hardware-based systems that perform the specified functions or acts, or combinations of special purpose hardware and program code.

FIG. 1 depicts a schematic block diagram of one embodiment of a system 100 for reserve management for a continuous bidding portal. In one embodiment, the system 100 includes one or more auction management devices 102 such as servers, desktop computers, laptop computers, or the like. In certain embodiments where the computing auction management devices 102 are servers, the servers may include blade servers, virtual servers, cloud servers, remote servers, network servers, or the like. The auction management devices 102 may be grouped into one or more physical groups, logical groups, functional groups, or the like. In some embodiments, the auction management devices 102 may be part of a data center and may be physically located in the same facility or in remote locations. Auction management devices 102, in certain embodiments, are configured to store, access, host, process, coordinate, synchronize, or the like, data associated with an online auction, as described below.

The system 100, in another embodiment, includes one or more computing devices 104*a-n*, such as servers, configured to be auction platforms. An auction platform 104*a-n*, as used herein, is a platform configured to host an online auction. An online auction may be an auction that is accessible via a network 108*b*, such as the Internet, an intranet, or the like. In one embodiment, the auction platforms 104*a-n* may present an interface, such as a web page, for users to post listings for items for sale, bid on items for sale, buy items for sale, view items for sale, or the like. In a traditional online auction, for example, a user may visit a web page where the auction is being hosted, view products that are for sale, and enter one or more bids on the products until a specified auction end time is reached. Generally, the user with the highest bid wins the auction and the opportunity to purchase the product for the bid price. In some embodiments, an auction platform 104*a-n* provides an option for a user to buy the item immediately (e.g., a "buy it now" option), without bidding on the item and waiting for the auction end time to be reached. The auction platforms 104*a-n* may be configured to host auctions for various products, such as vehicles, electronics, tools, clothes, furniture, or the like.

In certain embodiments, users visit auction platforms 104*a-n* using one or more information handling devices 106, such as desktop computers, laptop computers, tablet computers, smart phones, smart watches or other wearable devices, smart TVs, or the like that are communicatively coupled to the auction platforms 104*a-n* via a network 108*b*. For example, a user may visit a web site hosted by an auction platform 104*a-n* using an iPad® or other tablet computer. The user may use the interface provided by the auction platform 104*a-n* to view items for sale, bid on an item for sale, complete a purchase for an item, or the like.

In one embodiment, the information handling devices 106 are communicatively coupled to one or more auction platforms 104*a-n* via a first data network 108*b*. Similarly, the auction platforms 104*a-n* are communicatively coupled to the auction management devices 102 via a second data network 108*a*. In some embodiments, the first data network 108*b* is the same data network as the second data network 108*a*, such as the Internet. The data networks 108*a*, 108*b*, in one embodiment, comprise digital communication networks that transmit digital communications. The data networks 108*a*, 108*b* may include wireless networks, such as a wireless cellular networks, local wireless networks, such as Wi-Fi networks, Bluetooth® networks, near-field communication (NFC) networks, ad hoc networks, and/or the like. The data networks 108*a*, 108*b* may include wide area networks (WANs), storage area networks (SANs), local area networks (LANs), optical fiber networks, the internet, or other digital communication networks. The data networks 108*a*, 108*b* may include two or more networks. The data networks 108*a*, 108*b* may include one or more servers, routers, switches, and/or other networking equipment. The data network 108*a*, 108*b* may also include computer readable storage media, such as a hard disk drive, an optical drive, non-volatile memory, random access memory (RAM), or the like.

In some embodiments, auction platforms 104*a-n* are independent entities that do not communicate with each other. Thus, in certain embodiments, if a user desires to post a listing for an item at each auction platform 104*a-n*, the user may be required to create a separate product listing for the item on each auction platform 104*a-n*, which may be cumbersome and time consuming to create, monitor, and maintain. For example, a user that is selling his car may be required to create separate listings for his car on auction platform A, auction platform B, and auction platform C in order to generate the most exposure for his listing. However, the user may have to monitor each auction platform 104*a-n* to determine whether other users are bidding on his car, whether his car has been sold under a "buy it now" option, or the like. Examples of different auction platforms 104*a-n* for vehicles may include SmartAuction, Manheim OVE, and Adesa-OpenLane.

Additionally, when the auction is finished, the user may be required to manually remove the listing from each auction platform 104*a-n* and/or re-post the listing for the car if the car did not sell. Furthermore, in various embodiments, when a bid for an item is received from a user on a particular auction platform 104*a-n*, listings for the item on different auction platforms 104*a-n* are removed such that the item may only be bid on and purchased by users of the auction platform 104*a-n* that entered the first bid.

On the other hand, the auction management devices 102, in certain embodiments, monitor, manage, coordinate, or the like, bidding activity among the different auction platforms 104*a-n*. In the example above, if a user were to bid on a car listing using auction platform A, instead of removing the car listing from other auction platforms 104*a-n*, the auction management devices 102 may update bid information for the listing on the other auction platforms 104*a-n*, such as the current bid price, which is an improvement upon existing online auction systems. Furthermore, the auction management devices 102 manage reserve price and bid information such that when a reserve price for an auction item is met at one auction platform 1041-*n*, the auction management devices 102 can remove the listing for the auction item from the other auction platforms 104*a-n* while continuing the auction for the auction item at the auction platform 104*a-n* where the bid that met the reserve price is received.

In one embodiment, an auction module 110, which at least a portion of may be located on the auction management devices 102, the auction platforms 104*a-n*, and/or the information handling devices 106, facilitates the monitoring, maintenance, management, or the like of item listings on a plurality of auction platforms 104*a-n*. In one embodiment, the auction module 110 receives a notification comprising bid information, including a bid amount, for an auction item posted on a first auction platform 104*a-n*. In a further embodiment, the auction module 110 determines that the bid amount satisfies a reserve price for the auction item posted on the first auction platform 104*a-n*. In certain embodiments, the auction module 110 sends a notification to one or more second auction platforms 104*a-n* where the auction item is posted to remove auction listings for the auction item from the one or more second auction platforms 104*a-n* in response to the reserve price for the auction item being met at the first auction platform 104*a-n*. As described below with reference to FIG. 2, the auction module 110 may utilize one or more different modules to perform the functions of the auction module 110.

In certain embodiments, the auction module 110 communicates with the various auction platforms 104*a-n* using web services, application programming interfaces ("APIs"), or other mechanisms. As used herein, web services are methods of communication between two devices over a network 108*a*, 108*b*. Specifically, a web service is a software function provided at a network address where the web service is always on. Web services may integrate web-based applications using a modeling language (XML, JSON) to tag the data, a messaging protocol (SOAP or similar protocol) to transfer the data, a web service definition language (WSDL—typically XML-based) to describe the services that are available, and a registry (e.g., universal description, discovery, and integration (UDDI)—a platform-independent, XML-based registry) to where the web services can be listed.

In some embodiments, certain auction platforms 104*a-n* may not be compatible with certain web services utilized by the auction module 110. Some auction platforms 104*a-n* may choose not to participate in continuous bidding. In either of these embodiments, these auction platforms 104*a-n* are considered "non-continuous bidding" auction platforms 104*a-n* because the auction platforms 104*a-n* may not be able to send, receive, and/or process updates to/from the auction module 110 or may choose not to participate in the continuous bidding process. Accordingly, in certain embodiments, when a bid for an item is received from a different auction platform 104*a-n*, the listing is removed from each non-continuous bidding auction platform 104*a-n* because the non-continuous bidding auction platforms 104*a-n* are not capable of receiving and sending updated bid notifications to/from the action module 110 or have chosen not to participate in the continuous bidding process.

On the other hand, auction platforms 104*a-n* that are compatible with the web services utilized by the auction module 110 are considered "continuous bidding" auction platforms 104*a-n* because the auction platforms 104*a-n* are capable of sending, receiving, and processing updates to/from the auction module 110. Accordingly, in certain embodiments, when a bid for an item is received from a different auction platform 104*a-n*, the listing for the item on the continuous bidding auction platforms 104*a-n* is updated to reflect the new bid price because the continuous bidding auction platforms 104*a-n* are capable of receiving and sending updated bid notifications to/from the action module 110.

However, in certain embodiments disclosed herein, when an auction item that is listed at a plurality of different auction platforms 104*a-n* includes a reserve price, when a bid amount for an item satisfies or meets the reserve price at an auction platform 104*a-n*, the auction module 110 removes the listing for the auction item from other auction platforms 104*a-n*, regardless of whether the other auction platforms 104*a-n* are continuous or non-continuous auction platforms. The auction module 110, however, continues the auction for the auction item at the auction platform 104*a-n* where the bid amount is received that satisfies the reserve price.

Figure 2:
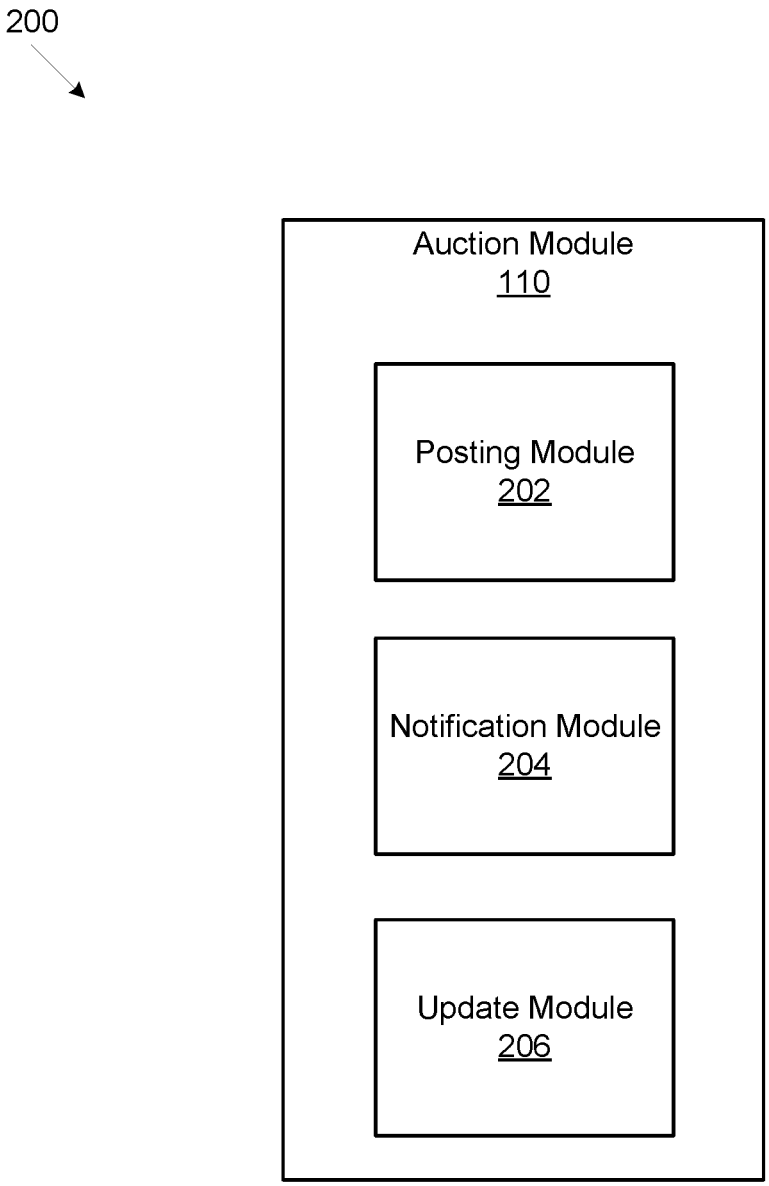
FIG. 2 depicts a schematic block diagram of one embodiment of a module for reserve management for a continuous bidding portal.

FIG. 2 depicts a schematic block diagram of one embodiment of a module 200 for reserve management for a continuous bidding portal. In one embodiment, the module 200 includes an instance of an auction module 110. The auction module 110, in some embodiments, includes one or more of a posting module 202, a notification module 204, and an update module 206, which are described in more detail below.

The posting module 202, in one embodiment, is configured to post a listing for an item for sale on a plurality of auction platforms 104*a-n*. The listing, in certain embodiments, may include various information describing the item for sale including the initial bid price, a reserve price (the lowest price the seller is willing to accept), an auction end time, a "buy it now" price, a product description, images of the product, seller information, or the like. As described in more detail below, the create module 304 may facilitate the creation of an item listing. For example, a user may create a listing for a vehicle that includes an initial bid price of $10,000, a reserve price of $10,000, an end date set for one week from the time the listing is posted, the vehicle identification number ("VIN"), images of the vehicle, and a description of the vehicle.

The posting module 202, as described above, may communicate with the various auction platforms 104*a-n* via a data network 108*a* using a web service to send the item listing to the auction platforms 104*a-n*. In response to receiving the listing for the item, the auction platforms 104*a-n* may post the listing on their respective interfaces, e.g., websites, for users to view and bid on.

In one embodiment, the notification module 204 is configured to receive a notification from an auction platform 104*a-n* in response to an auction event associated with the item listing. The auction event, in some embodiments, includes a bid for a listed item, a "buy it now" purchase of the item, a question about the item, removal of the listing from an auction platform 104*a-n*, expiration of the listing of the item, or the like. The notification received by the notification module 204 may include the type of event and information associated with the event. For example, the notification module 204 may receive a bid notification, indicating that the listing received a bid from a user, and the amount of the bid, the new bid price, and/or the date/time of the bid.

In some embodiments, the notification module 204 receives notifications from auction platforms 104*a-n* synchronously or asynchronously in response to a message being sent to the auction platforms 104*a-n*. For example, in synchronous mode, certain messages sent to the auction platforms 104*a-n* may require a response before proceeding, and, therefore a notification would need to be received by the notification module 204 before processing could continue. On the other hand, in asynchronous mode, some messages may not require a response before proceeding, and therefore a notification would not need to be received by the notification module 204 before processing could continue.

The update module 206, in one embodiment, is configured to update information for the listing on one or more different auction platforms 104*a-n* in response to receiving the auction event notification in real-time, meaning that the listing information for the item at an auction platform 104*a-n* is updated quickly such that the user is unaware that the auction platform 104*a-n* is communicating with the update module 206. For example, if the notification module 204 receives a bid notification, the update module 206 may push the information associated with the bid notification, such as the bid amount and the new bid price of the item, as well as the date/time of the bid, to the other auction platforms 104*a-n* that have a listing for the item so that the other action platforms 104*a-n* can update the bid information for the listing of the item. Similarly, if the notification module 204 receives a notification from an auction platform 104*a-n* that an item was purchased using a "buy it now" option, the update module 206 may send an update to the other auction platforms 104*a*-n that have a listing for the item that the item has sold so that they can deactivate, remove, delist, or the like, the listing for the item.

In certain embodiments, if the notification module 204 receives a bid notification from any auction platform 104*a-n*, the update module 206 sends an update to the non-continuous bidding auction platforms 104*a-n* to remove the listing of the item because the non-continuous bidding auction platforms 104*a-n* are not participating or cannot participate in a continuous bidding auction due, at least in part, to the non-continuous bidding auction platforms' incompatibility with the web services being used by the auction module 110. In some embodiments, if the notification module 204 receives a bid notification from a non-continuous bidding auction platform 104*a-n*, the update module 206 sends a notification to each non-continuous bidding auction platform 104*a-n* to remove the listing for the item except the auction platform 104*a-n* that received the bid because the auction platform 104*a-n* that received the bid is capable of receiving additional internal bids if and until a bid from a continuous bidding auction platform 104*a-n* is received.

In some embodiments, the update module 206 may provide data to the auction platforms 104*a-n* such that the auction platforms 104*a-n* may check and "pull" data for its listings. In one embodiment, the update module 206 may make accessible listing data, auction data, product data, seller data, or the like. The auction platforms 104*a-n* may send a request for certain data, and the update module 204 may send the requested data, if available, using a web service.

In another embodiment, an auction platform 104*a-n* that receives a bid for a listing may use a web service to pull data for the listing to check whether the received bid is the highest bid. If the received bid for the listing is the highest bid received from all the auction platforms 104*a-n* where the listing is posted, the update module 206 will lock the bid as the highest bid. If the received bid is not the highest bid for the listing, the update module 206 may send a message, notification, etc., to the auction platform 104*a-n* that received the bid to indicate that a different bid is currently the highest bid, e.g., a higher bid may have been received from a different auction platform 104*a-n* before the current bid was received. In certain embodiments, it may be beneficial to pull data where there occurs an outage in the system 100, or in particular at the auction platforms 104*a-n*, so that the auction platforms 104*a-n* can re-sync item listings by pulling data provided by the update module 206 and/or confirm that a received bid is the high bid prior to accepting the bid.

Figure 3:
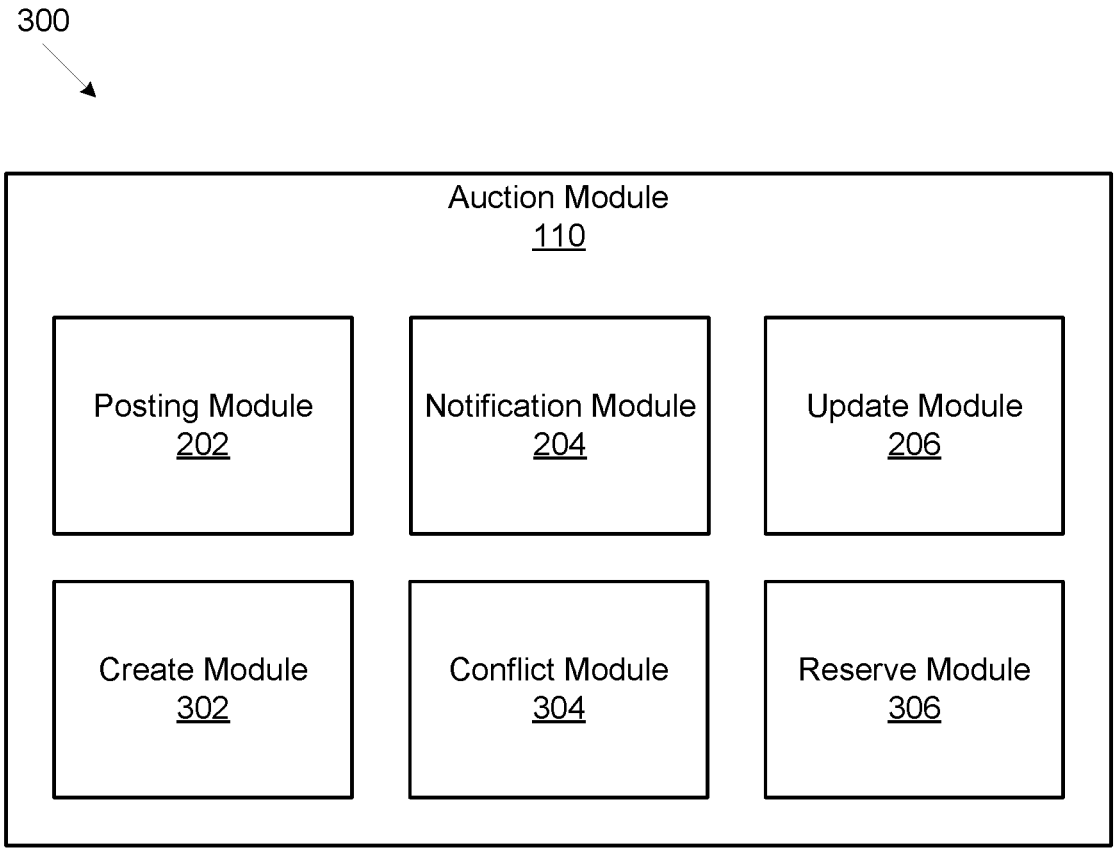
FIG. 3 depicts a schematic block diagram of one embodiment of another module for reserve management for a continuous bidding portal.

FIG. 3 depicts a schematic block diagram of one embodiment of another module 300 for reserve management for a continuous bidding portal. In one embodiment, the module 300 includes an instance of an auction module 110. The auction module 110, in certain embodiments, includes one or more of a posting module 202, a notification module 204, and an update module 206, which may be substantially similar to the posting module 202, the notification module 204, and the update module 206 described above with reference to FIG. 2. In a further embodiment, the auction module 110 includes one or more of a create module 302, a conflict module 304, and a reserve module 306, which are described below.

The create module 302, in one embodiment, is configured to create a listing for an item. The create module 302, in various embodiments, receives information from a user regarding the product that the user is selling and creates a listing for the product that can be displayed on various auction platforms 104*a-n*. For example, if a user is creating a listing for a vehicle, the create module 302 may receive a description of the vehicle, one or more images of the vehicle, the VIN for the vehicle, the initial bid price, a "buy it now" price, an auction end date/time, a reserve price, and/or the like. In certain embodiments, the create module 302 creates a listing using a modeling language, such as XML, which can be sent to the various auction platforms 104*a-n* by the posting module 202 using one or more web services/APIs.

In some embodiments, the auction end date/time is the same for each auction platform 104*a-n* to ensure that the length of the auction is consistent across all auction platforms 104*a-n*. In certain embodiments, the winning bidder is the bidder with the highest bid as of the auction end time. In a further embodiment, the update module 206 may update the listing information, including the auction end date/time, at any point during the auction. In one embodiment, if the notification module 204 receives a bid notification within a predetermined time of the listing's end date/time, the update module 206 extends the auction end date/time by a period of time.

For example, if a bid is received within five minutes of the specified auction end date/time, the update module 204 may extend the auction end date/time by five minutes to account for processing delays and provide users of other auction platforms 104*a-n* an opportunity to bid on the product. In various embodiments, the auction ends a predetermined time after the initial auction end date/time to ensure bidding does not continue indefinitely. For example, an auction may have a hard stop time of thirty minutes such that the auction can only be extended up to thirty minutes past the specified auction end date/time.

In some embodiments, the end date/time may be an absolute end date/time for a listing that has multiple iterations. As used herein, an iteration for a listing is the number of times, e.g., days, that a listing is posted on an auction platform 104*a-n*. For example, a vehicle listing may be posted to an auction platform 104*a-n* every day for seven days, as specified by the end date/time (assuming no bids are placed on the vehicle when it is posted). In some embodiments, the auction management devices 102 maintain, set, monitor, etc., the auction end date/time across multiple auction platforms 104*a-n*, and each auction platform 104*a-n* manages posting the listing for each iteration and performs its own end of sale processing if it is the auction platform 104*a-n* that received the winning bid.

In certain embodiments, after a listing is created by the create module 302, the posting module 202 posts the listing to a plurality of auction platforms 104*a-n*. In response to the listing being posted at the auction platforms 104*a-n*, the notification module 204 may receive a listing notification from each auction platform 104*a-n* to confirm that the listing was posted. In some embodiments, the auction may not have started at a given auction platform 104*a-n* if the notification module 204 did not receive a listing notification from the given auction platforms 104*a-n* selected to host the listing. In other embodiments, the auction will begin regardless of whether a listing notification is received from one or more auction platforms 104*a-n*.

In some embodiments, if the notification module 204 receives a listing notification from an auction platform 104*a-n* after a bid notification has been received from a different auction platform 104*a-n*, the update module 204 sends updated bid information, such as the current bid price, to the auction platform 104*a-n* that sent the listing notification. This ensures that the correct bid information is reflected in the listing as soon as it is posted.

In one embodiment, if the notification module 204 does not receive a listing notification within a period of time after the posting module 202 sent the listing information and/or a posting error notification is received from an auction platform 104*a-n* indicating that the listing was not posted correctly, the posting module 202 may re-post the listing to the auction platform 104*a-n*.

The conflict module 304, in one embodiment, is configured to select a bid of a plurality of bids received substantially at the same time from different auction platforms 104*a-n*. As used herein, bids received substantially at the same time may mean bid notifications that are received by the notification module 204 within a predetermined time period of one another, such as 100 milliseconds, 500 milliseconds, 1 second, or the like, or bids that are received at different auction platforms 104*a-n* within a predetermined time period of one another. Accordingly, bid notifications may include a timestamp indicating when a bid was entered at an auction platform 104*a-n*.

The conflict module 304, in one embodiment, selects a bid of a plurality of bids received substantially at the same time by determining which bid was received first, but still within the time period that the bids are considered to be received at the same time. Thus, the conflict module 304 may determine which bid was received first by determining which bid was entered first at the auction platform 104*a-n* or which bid notification the notification module 204 received first.

In one embodiment, the reserve module 306 is configured to determine whether a received bid amount satisfies a reserve price for an auction item listed at an auction platform 104*a-n*. As used herein, a reserve price is the minimum amount that the owner of an item up for auction will accept as the winning bid in the auction. In certain embodiments, the reserve price prevents the auction from being won by a bidder who offers a price lower than the item's owner will accept. In some embodiments, the reserve module 306 polls the auction platforms 104*a-n* at predetermined intervals to determine whether the reserve price has been met at the auction platforms 104*a-n*.

In certain embodiments, the reserve price is set as part of creating the auction item listing. The reserve module 306 may store the reserve price for an auction item at an auction platform 104*a-n* where the item is listed and/or at an auction management device 102. Thus, when a bid notification is received that includes the bid amount for the auction item, the reserve module 306 (1) checks at the auction platform 104*a-n* where the item is listed whether the received bid amount satisfies the reserve price for the auction item and sends a notification to the auction management device that the reserve price has been met and/or (2) checks at the auction management device 102 where the notification of the bid amount is received to determine whether the bid amount satisfies the reserve price for the auction item and sends a notification to the auction platform 104*a-n* where the bid was received that the reserve price has been met. For instance, the reserve module 306 may compare the received bid amount to the reserve price at the auction management device 102.

In various embodiments, the auction platform 104*a-n*, e.g., a reserve module 306 located at an auction platform 104*a-n*, periodically polls the auction management device 102 to determine whether the reserve price for an auction item has been met at a different auction platform 104*a-n*. For instance, the reserve module 306 may poll the auction management device 102 every 30 seconds to determine whether the reserve price has been met at another auction platform 104*a-n*.

In some embodiments, when the reserve module 306 determines that the reserve price has been met, the notification module 202, the update module 206, and/or the reserve module 306 sends a notification to other auction platforms 104*a-n* where the auction item is posted that the reserve price has been met on the auction platform 104*a-n*, and instructs, triggers, commands, or the like the other auction platforms 104*a-n* to remove the auction item listing from the auction platforms 104*a-n*. In certain embodiments, the auction item listing is removed when the reserve price is satisfied even if there are additional iterations available for posting the auction item at the auction platform 104*a-n*.

In various embodiments, the reserve module 306 continuously sends the notification to remove the auction listing to each of the other auction platforms 104*a-n* until a confirmation notification, an acknowledgement, and/or the like is received from each of the other auction platforms 104*a-n*. The reserve module 306, for instance, may send the notification to remove the auction listing at predefined intervals such as every 30 seconds, every minute, and/or the like. In further embodiments, the reserve module 306 polls the other auction platforms 104*a-n* to determine whether the auction item listing has been removed from the auction platforms 104*a-n*. The reserve module 306, for instance, may poll the auction platforms 104*a-n* at predefined intervals such as every 30 seconds, every minute, and/or the like to determine whether the auction item listing has been removed.

In one embodiment, after the reserve price is met at an auction platform 104*a-n*, and the auction item listing is subsequently removed from other auction platforms 104*a-n*, the auction platform 104*a-n* where the bid that satisfied the reserve price was received continues the auction for the auction item until the end of the auction, e.g., until the auction end date/time.

In one embodiment, the update module 306 extends the auction end time at each of the auction platforms 104*a-n* where the auction item is listed until a reserve price for the auction item is met. For example, if the auction item listing was scheduled to end on January 1, but the reserve price has not yet been met at any of the auction platforms 104*a-n*, the update module 306 may extend the auction end time at each of the auction platforms 104*a-n* for a predetermined period of time, e.g., a day, a week, a month, etc.

In one embodiment, notifications that include the reserve information, e.g., notifications for removing auction item listings from an auction platform 104*a-n*, in addition to the notifications discussed above, are sent and received between an auction management device 102 and an auction platform 104*a-n* using various APIs. For instance, the auction management device 102 and the various auction platforms 104*a-n* may use different APIs for formatting, sending, and receiving notifications. For instance, the auction management device 102 may format messages that are sent to an auction platform 104*a-n* using the API of the auction platform 104*a-n*, and may convert messages received from an auction platform 104*a-n* from the auction platform 104*a-n* API format to a format compatible with the auction management device 102 API.

Figure 4:
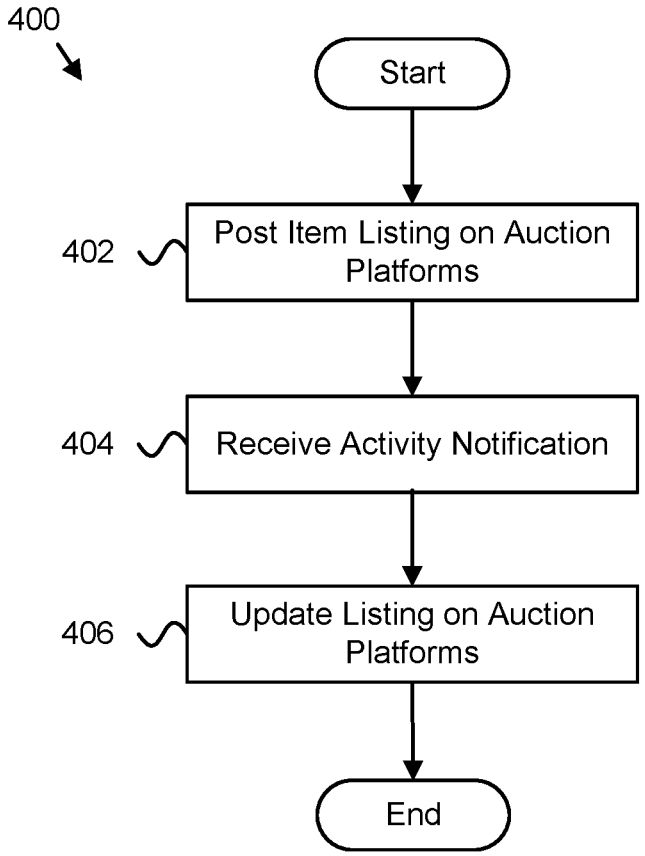
FIG. 4 depicts a schematic flow-chart diagram of one embodiment of a method for reserve management for a continuous bidding portal.

FIG. 4 depicts a schematic flow-chart diagram of one embodiment of a method 400 for reserve management for a continuous bidding portal. In one embodiment, the method 400 begins and posts 402 a listing for an item for sale to a plurality of auction platforms 104*a-n*. In some embodiments, the posting module 202 posts 402 the listing for the item to a plurality of auction platforms 104*a-n*.

In a further embodiment, the method 400 receives 404 a notification from an auction platform 104*a-n* in response to an auction event associated with the item listing. An auction event may include a bid for an item, a purchase of an item (e.g., through a "buy it now" option), a removal of the listing from the auction platform 104*a-n*, or the like. In one embodiment, the notification module 204 receives 404 the notification of an auction event associated with the listing.

In one embodiment, the method 400 updates 406 information for the listing on one or more different auction platforms 104*a-n* in response to receiving the notification. An update may include updating a bid price for an item on auction platforms 104*a-n* where the item is listed in response to the method 400 receiving a bid notification from a different auction platform 104*a-n*. Another update may include sending a message that the item has been purchased under a "buy it now" option in response to the method 400 receiving a "buy it now" notification indicating so that the listing can be removed from the auction platforms 104*a-n*. In one embodiment, the update module 206 updates 406 information for the listing on the auction platforms in response to receiving the notification, and the method 400 ends.

Figure 5A:
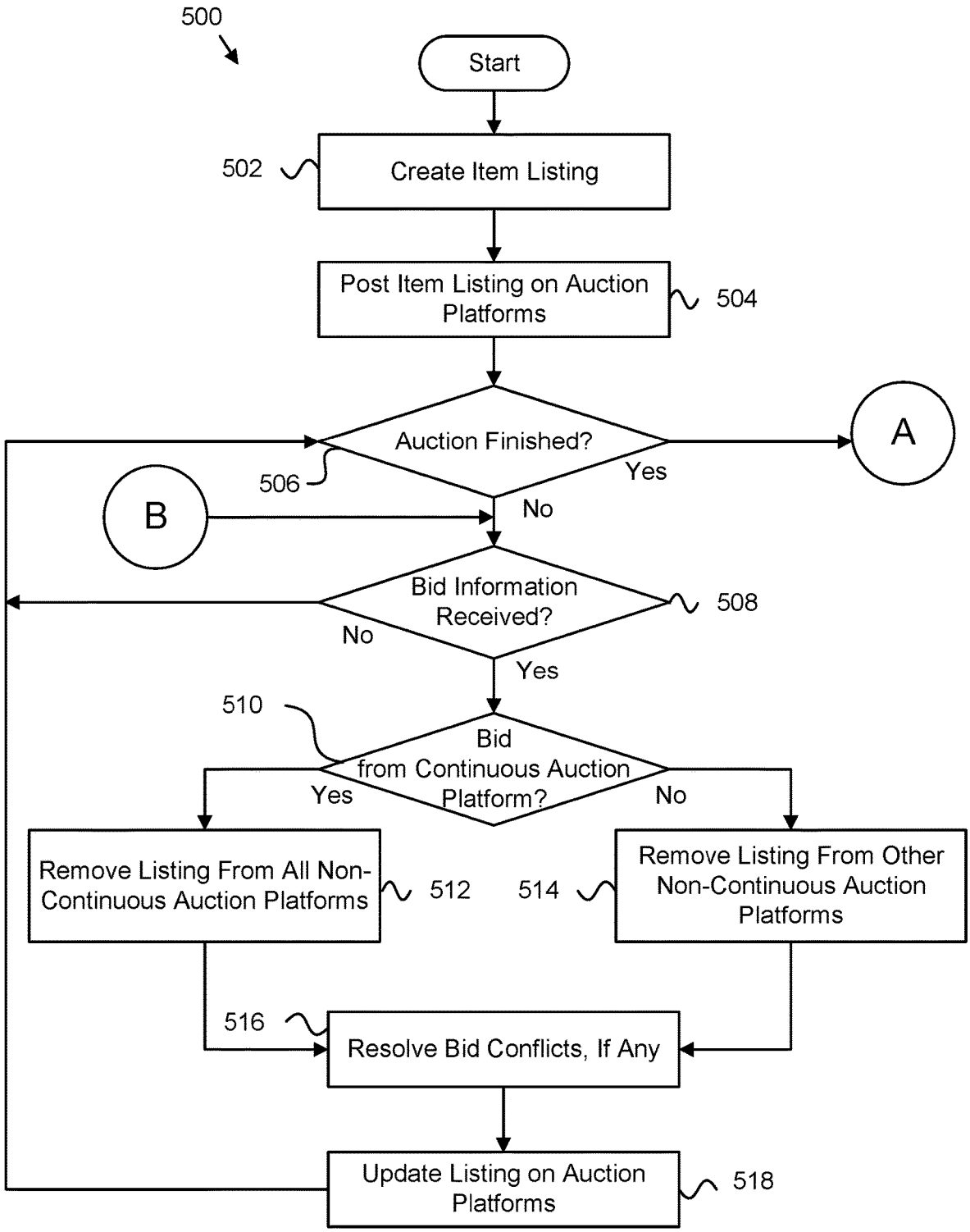
FIG. 5A depicts a first portion of a schematic flow chart diagram of one embodiment of a method for reserve management for a continuous bidding portal.
Figure 5B:
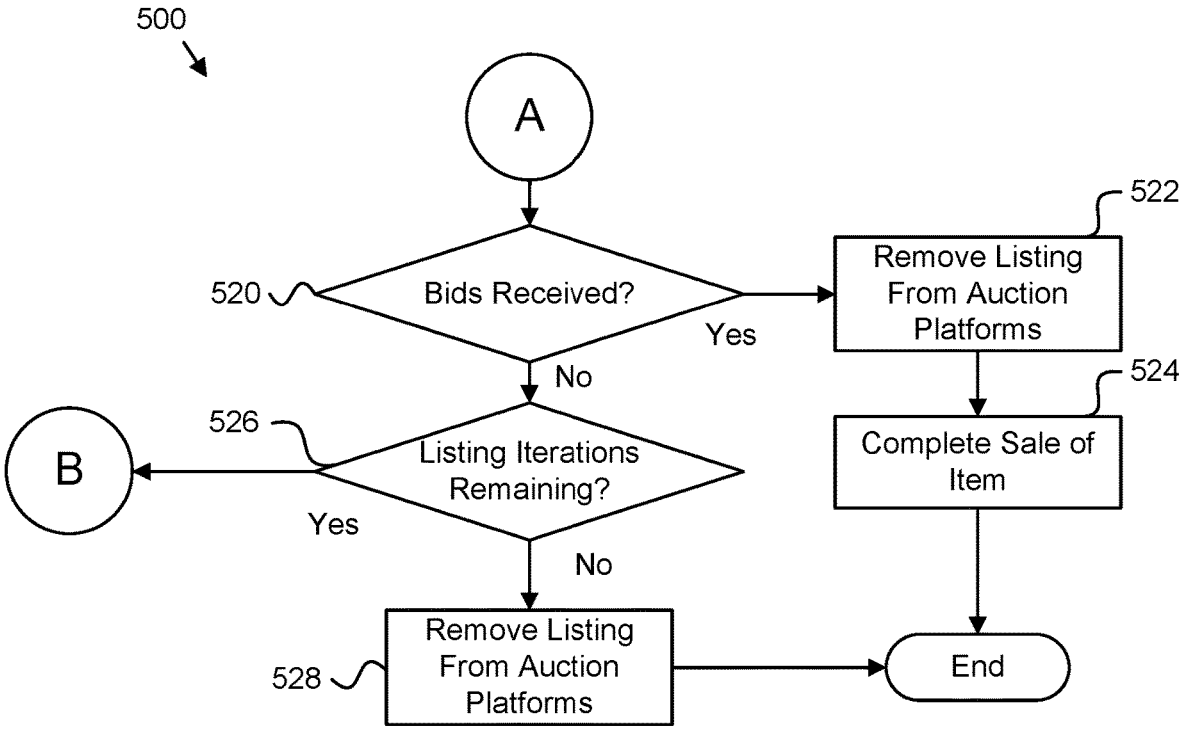
FIG. 5B depicts a second portion of a schematic flow chart diagram of one embodiment of a method for reserve management for a continuous bidding portal.

FIGS. 5A and 5B depict a first portion and a second portion, respectively, of a schematic flow chart diagram of one embodiment of a method 500 for reserve management for a continuous bidding portal. In one embodiment, starting at FIG. 5A, the method 500 begins and creates 502 a listing for an item. In certain embodiments, the method 500 creates 502 the listing for the item based on input received from a user, such as an item description, one or more images of the item, a starting bid price for the item, a "buy it now" price for the item, information associated with the seller of the item, and/or the like. In some embodiments, the create module 302 creates 502 a listing for an item.

In a further embodiment, the method 500 posts 504 the item listing on one or more auction platforms 104*a-n*. The method 500, in one embodiment, determines 506 if the auction is completed, which may be based on whether the product has sold, the end date/time of the auction has been reached, the end date/time of an iteration of the auction has been reached, or the like. If the method 500 determines 506 that the auction is not finished, the method 500 determines 508 if bid information has been received. If the method 500 determines 508 that bid information has not been received, the method 500 continues to monitor 508 for bid notifications while the auction is still live.

If the method 500, in one embodiment, determines 508 that a bid notification was received, the method 500 further determines 510 whether the bid notification was received from a continuous bid or non-continuous bid auction platform 104*a-n*. If the method 500, in another embodiment, determines 510 that the bid notification was received from a continuous bid auction platform 104*a-n*, the method removes 512 the item listing from the non-continuous bid auction platforms 104*a-n*. For example, the method 500 may send a message to the non-continuous bid auction platforms 104*a-n* indicating that a bid for the item has been received and that the item should be removed from the non-continuous bid auction platform's 104*a-n* listings.

If the method 500, in certain embodiments, determines 510 that the bid was not received from a continuous bid auction platform 104*a-n*, and therefore was received from a non-continuous bid auction platform 104*a-n*, the method 500 removes 514 the listing from other non-continuous bid auction platforms 104*a-n* that did not receive the bid. In a further embodiment, regardless of whether the bid notification was received 512, 514 from a continuous bid or non-continuous bid auction platform 104*a-n*, the method 500 resolves 516 any bid conflicts if two or more bids are received at substantially the same time.

In certain embodiments, as described above, the method 500 resolves 516 bid conflicts by selecting the bid that was received first based on when the bid notification was received from the auction platforms 104*a-n*. In certain embodiments, the conflict module 304 resolves 516 bids that are received at substantially the same time.

In one embodiment, the method 500 updates 518 the item listing on one or more auction platforms 104*a-n* where the listing is still active. The method 500, for example, may send the time/date of the received bid, the amount of the bid, the new bid price, or the like to the other auction platforms 104*a-n*, using one or more web services, so that the auction platforms 104*a-n* can update the information for the item listing.

If the method 500 determines 506 that the auction is finished, the method 500 follows "A" to FIG. 5B and determines 520 whether any bids were received for the item. If the method 500 determines 520 that bids were placed on the item, the method 500 removes 522 the item listings from each auction platform 104*a-n* where the item is listed, and completes 524 the sale of the item at the auction platform 104*a-n* where the winning bid was received. Then the method 500 ends.

On the other hand, if the method 500 determines 520 that no bids were received for the item, the method 500 determines 526 whether the listing still has iterations remaining. As explained above, iterations may refer to the number of times the same product and/or listing for a product may be presented at the auction platforms 104*a-n*. For example, a vehicle listing may have seven iterations, meaning that the vehicle listing may be listed at an auction platform each day for seven days up until the auction end/date time. Thus, if the method 500 determines 526 that the item listing does have iterations remaining, the method 500 follows "B" to FIG. 5A and determines 508 whether any bids have been received for the listing on the auction platforms 104*a-n* that reposted the listing for the new iteration. Otherwise, if the method 500 determines 526 that the listing does not have any remaining iterations available, the listing will not be reposted, and the method 500 removes 528 the item listings from each auction platform 104*a-n* where the item is listed. Then the method 500 ends.

Figure 6:
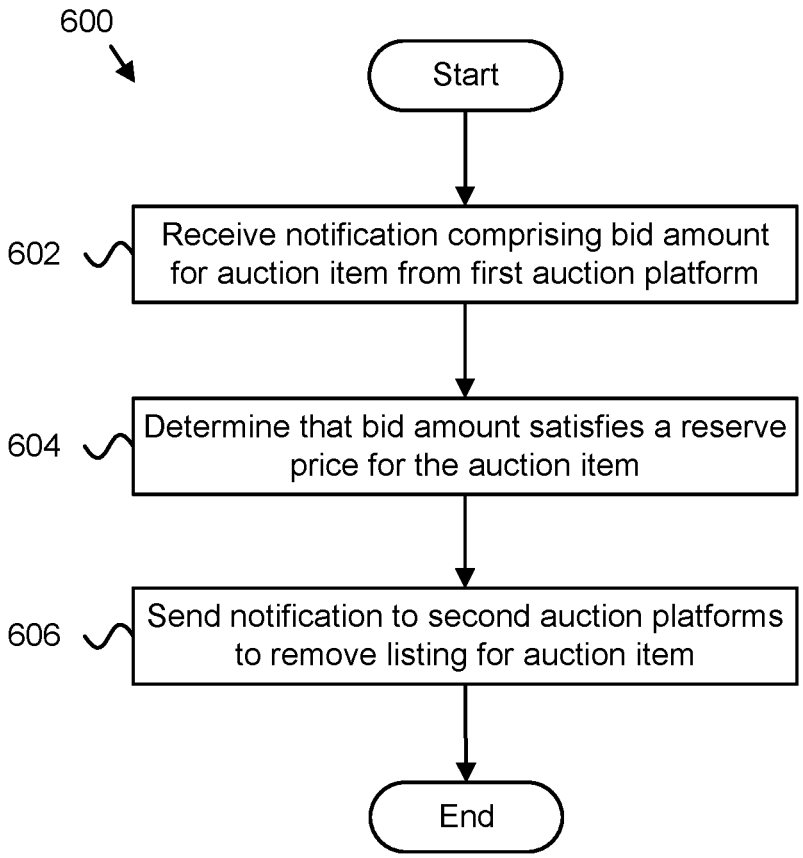
FIG. 6 depicts a schematic flow-chart diagram of one embodiment of a method for reserve management for a continuous bidding portal.

FIG. 6 depicts a schematic flow-chart diagram of one embodiment of a method 600 for reserve management for a continuous bidding portal. In one embodiment, the method 600 begins, and receives 602 a notification comprising bid information for an auction item posted on a first auction platform 104*a-n*. The bid information may include a bid amount. In further embodiments, the method 600 determines 604 that the bid amount satisfies a reserve price for the auction item posted on the first auction platform 104*a-n*. In certain embodiments, the method 600 sends 606 a notification to one or more second auction platforms 104*a-n* where the auction item is posted to remove auction listings for the auction item from the one or more second auction platforms 104*a-n* in response to the reserve price for the auction item being met at the first auction platform 104*a-n*, and the method 600 ends.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A method comprising:

receiving, at an auction management device from a first auction platform of a plurality of auction platforms over a data network and via a web service, a notification comprising bid information for an auction item posted on the first auction platform, the bid information comprising a bid amount;

determining, at the auction management device, that the bid amount received from the first auction platform satisfies a reserve price for the auction item posted on the first auction platform and that the bid information is for a bid that is received at the auction management device prior to at least one other bid that satisfies the reserve price, the at least one other bid received from one or more second auction platforms of the plurality of auction platforms where the auction item is posted;

sending a notification, via the web service, from the auction management device over the data network to the one or more second auction platforms where the auction item is posted to remove auction listings for the auction item from the one or more second auction platforms in response to the bid information received from the first auction platform satisfying the reserve price for the auction item being met at the first auction platform and in response to the bid information being received at the auction management device prior to the at least one other bid that satisfies the reserve price being received at the auction management device;

continuously sending, via the web service, from the auction management device over the data network and in response to not receiving a confirmation that the auction listing has been removed from the one or more second auction platforms, the notification to remove the auction listing to the one or more second auction platforms until a confirmation notification is received indicating that the auction listing has been removed; and continuing the auction for the auction item at the first auction platform by maintaining the listing for the auction item at the first auction platform until a specified end time of the auction.

2. The method of claim 1, further comprising selecting a bid of a plurality of bids received substantially at a same time from different auction platforms, the bid selected based on the time the notifications were received from the auction platforms.

3. The method of claim 2, further comprising sending a notification to each auction platform associated with each bid that is not selected that the bid was rejected.

4. The method of claim 1, wherein determining that the bid amount satisfies a reserve price for the auction item posted on the first auction platform comprises receiving a notification from the first auction platform that the reserve price has been met.

5. The method of claim 1, wherein determining that the bid amount satisfies a reserve price for the auction item posted on the first auction platform comprises comparing the received bid amount to the reserve price at an auction management device.

6. The method of claim 1, further comprising creating the listing for the item, the listing comprising a description of the item, an initial bid price, an auction end time, a listing type, a reserve price, and one or more selected auction platforms where the listing is posted.

7. The method claim 6, further comprising extending the auction end time until a reserve price for the auction item is met at an auction platform.

8. The method of claim 6, wherein the listing further comprises a plurality of iterations for the listing, the plurality of iterations specifying a number of times the listing is listable at an auction platform to receive a bid amount satisfying the reserve price.

9. The method of claim 8, further comprising removing the listing from the one or more second auction platforms in response to the reserve price for the auction item being met at the first auction platform even if the listing has additional iterations at an auction platform.

10. The method of claim 1, wherein notifications comprising reserve information are sent and received between an auction management device and an auction platform using an application programming interface ("API"), the auction management device formatting sent messages according to the API of the auction platform and converting received messages from the format of the API of the auction platform.

11. The method of claim 10, wherein the notifications are formatted using one or more of extensible markup language ("XML") and JavaScript Object Notation ("JSON").

12. The method of claim 1, wherein an auction platform polls an auction management device at predetermined intervals to determine if a reserve price has been met for the auction item at a different auction platform.

13. An apparatus comprising:

a processor;

a memory that stores code executable by the processor to:

receiving, at an auction management device from a first auction platform of a plurality of auction platforms over a data network and via a web service, a notification comprising bid information for an auction item posted on the first auction platform, the bid information comprising a bid amount;

determining, at the auction management device, that the bid amount received from the first auction platform satisfies a reserve price for the auction item posted on the first auction platform and that the bid information is for a bid that is received at the auction management device prior to at least one other bid that satisfies the reserve price, the at least one other bid received from one or more second auction platforms of the plurality of auction platforms where the auction item is posted;

sending a notification, via the web service, from the auction management device over the data network to the one or more second auction platforms where the auction item is posted to remove auction listings for the auction item from the one or more second auction platforms in response to the bid information received from the first auction platform satisfying the reserve price for the auction item being met at the first auction platform and in response to the bid information being received at the auction management device prior to the at least one other bid that satisfies the reserve price being received at the auction management device;

continuously sending, via the web service, from the auction management device over the data network and in response to not receiving a confirmation that the auction listing has been removed from the one or more second auction platforms, the notification to remove the auction listing to the one or more second auction platforms until a confirmation notification is received indicating that the auction listing has been removed; and continuing the auction for the auction item at the first auction platform by maintaining the listing for the auction item at the first auction platform until a specified end time of the auction.

14. The apparatus of claim 13, wherein determining that the bid amount satisfies a reserve price for the auction item posted on the first auction platform comprises receiving a notification from the first auction platform that the reserve price has been met.

15. The apparatus of claim 13, wherein determining that the bid amount satisfies a reserve price for the auction item posted on the first auction platform comprises comparing the received bid amount to the reserve price at an auction management device.

16. A system comprising:

an auction management device;

a first auction platform;

one or more second auction platforms;

a notification module configured to receive, at an auction management device from a first auction platform of a plurality of auction platforms over a data network and via a web service, a notification comprising bid information for an auction item posted on the first auction platform, the bid information comprising a bid amount;

a reserve module configured to determine, at the auction management device, that the bid amount received from the first auction platform satisfies a reserve price for the auction item posted on the first auction platform and that the bid information is for a bid that is received at the auction management device prior to at least one other bid that satisfies the reserve price, the at least one other bid received from one or more second auction platforms of the plurality of auction platforms where the auction item is posted;

an update module configured to send a notification, via the web service, from the auction management device over the data network to the one or more second auction platforms where the auction item is posted to remove auction listings for the auction item from the one or more second auction platforms in response to the bid information received from the first auction platform satisfying the reserve price for the auction item being met at the first auction platform and in response to the bid information being received at the auction management device prior to the at least one other bid that satisfies the reserve price being received at the auction management device, wherein the reserve module:

continuously sends, via the web service, from the auction management device over the data network and in response to not receiving a confirmation that the auction listing has been removed from the one or more second auction platforms, the notification to remove the auction listing to the one or more second auction platforms until a confirmation notification is received indicating that the auction listing has been removed; and continuing the auction for the auction item at the first auction platform by maintaining the listing for the auction item at the first auction platform until a specified end time of the auction.

* * * * *